US005571220A

United States Patent [19]

Hall

[11] Patent Number: 5,571,220

[45] Date of Patent: Nov. 5, 1996

[54] PROTECTIVE HEADGEAR FOR BASEBALL FIELDERS

[76] Inventor: Rex B. Hall, 2000 Chase Brook Dr., Hoover, Ala. 35244

[21] Appl. No.: 544,719

[22] Filed: Oct. 18, 1995

[51] Int. Cl.[6] ..... A42B 3/20

[52] U.S. Cl. ..... 2/424; 2/421

[58] Field of Search ..... 2/9, 15, 10, 424, 2/425, 421, 422, 410, 411

[56] References Cited

U.S. PATENT DOCUMENTS

| | | | |
|---|---|---|---|
| 2,785,405 | 3/1957 | Snyder | 2/9 |
| 2,944,263 | 7/1960 | Rayburn et al. | 2/9 |
| 3,067,427 | 12/1962 | McClintock, Sr. | 2/9 |
| 3,167,783 | 2/1965 | Wolfe | 2/9 |
| 3,886,596 | 6/1975 | Franklin et al. | 2/9 |
| 4,651,356 | 3/1987 | Zide | 2/421 |
| 4,885,806 | 12/1989 | Heller | 2/425 |
| 5,075,903 | 12/1991 | Richoux | 2/411 |
| 5,384,914 | 1/1995 | Caveness et al. | 2/9 |
| 5,477,565 | 12/1995 | Hunt, Jr. | 2/425 |

*Primary Examiner*—Michael A. Neas

[57] ABSTRACT

The specification describes a protective apparatus for use by baseball fielders. The protective apparatus is a helmet having a cap portion and a faceguard. The helmet is designed to protect against injuries caused by thrown or batted balls to the head and face of the fielder. The faceguard protects against injuries to the eyes, nose, mouth, chin, teeth, jaws, facial bones and the temporal regions of the head. In a preferred embodiment the helmet is designed for protection of both batters and fielders.

14 Claims, 4 Drawing Sheets

PROTECTIVE HEADGEAR FOR BASEBALL FIELDERS

FIELD OF THE INVENTION

This invention relates to protective headgear for baseballs players, and more specifically to helmets for use by baseball players when fielding balls.

SUMMARY OF THE INVENTION

Protective headgear is commonly used in a variety of sports involving bats, balls, sticks, heavy player contact, high speed autos and bicycles, and others. In baseball it has been standard many years for batters to wear helmets for protection against pitched baseballs, and for catchers to wear helmets, typically batters helmets, for protection against swinging bats. To date, baseball fielders typically wear soft felt caps when fielding baseballs. It has been my experience, through the administration of health care to young baseball players, that injuries frequently occur to baseball players engaged in fielding batted or thrown baseballs. Baseball players are particularly vulnerable to injuries in the field when they are young and inexpert. Injuries occur most often to the face, i.e., eyes, nose, and mouth. Occasional cheek-bone injuries occur, and injuries to the temple, while relatively rare, can be serious. Mouth injuries, in particular teeth injuries, and jaw injuries, are frequently the result of impact to the chin.

According to the invention, a single piece of baseball equipment is designed to avert, reduce or minimize the injuries just described. This equipment is a specially designed helmet intended to protect the front parts of the skull, particularly the face. The helmet is intended for use by players when fielding baseballs. It can also be adapted, in another embodiment, for use by players while fielding or batting.

DETAILED DESCRIPTION

Figure 1:
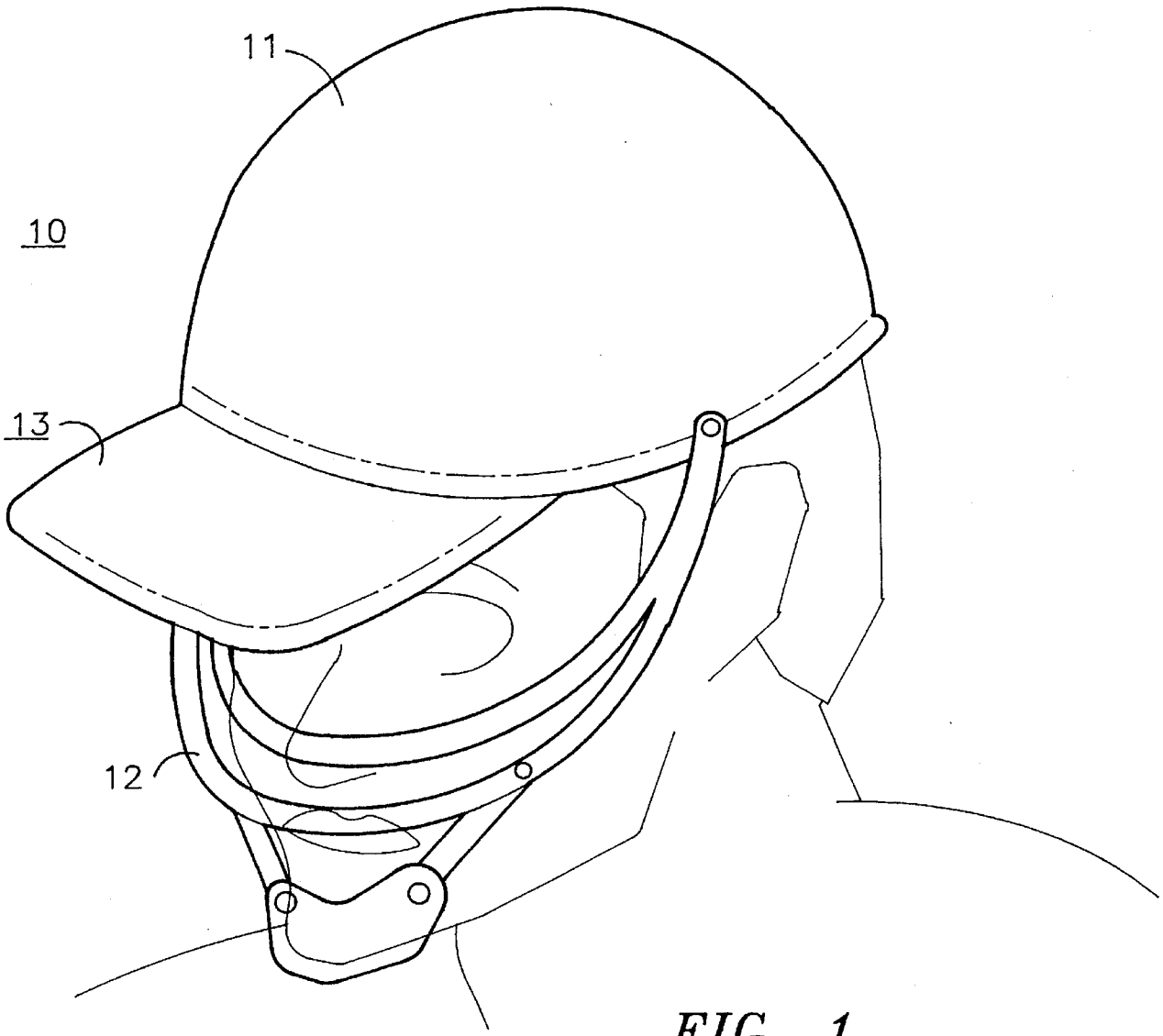
FIG. 1 is a perspective view of a protective baseball helmet and wearer according to the invention.

With reference to FIG. 1 a fielders helmet 10 is shown with cap portion 11 and protective faceguard 12. The cap portion 11 is a rigid material, typically plastic, and resembles the standard batting helmet used by baseball batters except in this embodiment the depending ear protective piece is not present. The cap portion has a visor, 13, adapted to shield the fielder's eyes from the sun.

Figure 2:
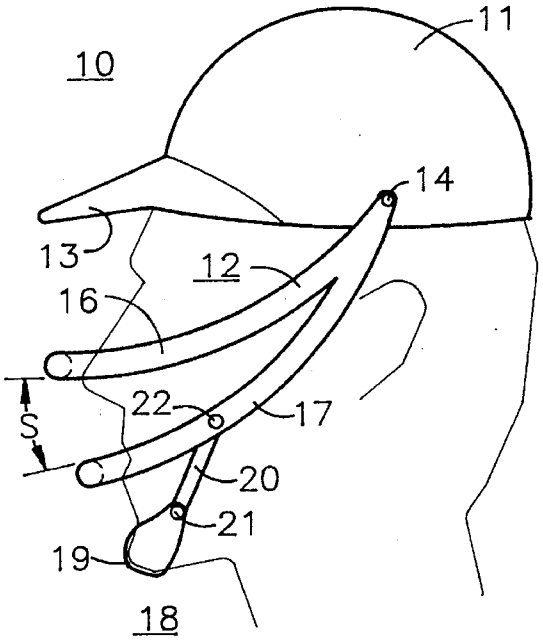
FIG. 2 is a side view of the protective helmet of FIG. 1.

With reference to FIG. 2, the faceguard 12 and its relation to the portions of the face being protected is seen in better detail. The faceguard is pivotally connected to the cap portion 11 by fastener 14. The location on the cap where the faceguard is attached is designed so that portions of the faceguard 12 protect the temporal regions of the head. It is also chosen so that the pivot action of the cap relative to the faceguard enables the helmet to be easily placed on or removed from the wearer as will be discussed in greater detail below. Also, the pivoting allows the faceguard to be rotated to a "rest" position on the bill of the cap when sitting in a dug-out or before and after competition. The point of attachment is on the rear half of the cap. In an alternative embodiment the fastener 14 rigidly connects faceguard 12 and cap 11 for reasons that will be discussed below.

The faceguard consists of a nose protective bar 16, a mouth protecting bar 17, and a chin guard 18. The chin guard 18 is affixed to the mouth protective bar 17 as shown. The spacing between the nose protective bar 16 and visor 13 when the helmet is worn is less than the diameter of a baseball, thus, protecting the eyes of the wearer. The diameter of a typical official baseball for young players is 2½". It is recommended that the nominal spacing between the nose protective bar 16 and the visor 13 of the cap, as measured when the helmet is being worn, is less than 2¼". In some cases it may be found that a ball that happens to impact precisely in the space between visor 13 and the nose protective bar 16 will force the cap upward or the nose protective bar downward (or both) sufficiently to allow the ball to come into contact with the eyes of the wearer. There are three solutions to this according to the invention. One is to make a rigid attachment using fastener 14. Another is to incorporate a stop on the cap to restrict the rotational angle of the faceguard with respect to the cap. A third is to use a retaining member attached between the faceguard and the cap. These expedients will be described in greater detail below. The spacing between the nose bar 16 and the mouth bar 17, which is designated "s" in FIG. 2, is typically 2 to 2¼ inches. The bars 16 and 17 are shown here as merging into one piece at or near the temple region of the head. This design affords the advantage that the spacing "s" is fixed, ensuring that one bar or the other cannot accidentally shift in use to expose either the nose or mouth to harm. Optionally the bars can be completely separate all the way to the fastener 14 and an added means provided to adjust and affix the spacing "s". The chin guard 18 consists of a chin cup 19, and a chin strap 20. The chin cup is typically plastic but may be leather or metal. It should be relatively rigid to impart protection to the chin as mentioned above. The chin strap 20 is typically cloth, and preferably elastic, although leather or a plastic material may also be used. The chin cup 19 is fastened to the strap 20 with fastener 21 as shown, and the strap 20 is affixed to the mouth protective bar 17 with fastener 22. The chin guard 18 is important for retaining the helmet in place during use, and for ensuring the proper positioning of the mouth protective bar 17 and the nose protective bar 16 with respect to the mouth and nose of the wearer. For this reason the strap 20 is most advantageously fastened to mouth protective bar 17 in the region of the wearer's cheek, thereby giving the correct angle to ensure proper engagement of the helmet with the wearer's head. If desired the strap 20 may include means for adjusting the length of the strap to accommodate different head sizes. A preferred form of chin guard according to this invention is a plastic chin cup lined with a resilient material such as foam rubber.

Figure 3:
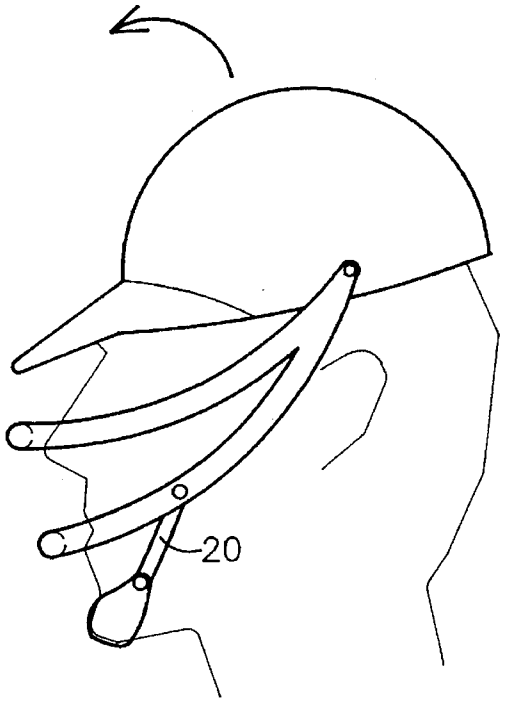
FIG. 3 is a view similar to that of FIG. 2 illustrating how the helmet may be removed.

As mentioned earlier, the pivot action of the cap relative to the faceguard enables the player to put on or take off the protective helmet with relative ease. This is done by tilting the visor 13 downward as shown in FIG. 3. For example, to remove the helmet the helmet is tilted forward and over the face thus releasing the chin guard. The reverse procedure is used in placing the helmet on. When the helmet is placed on or taken off in this manner it is not necessary for the strap 20 to be elastic. Accordingly, the strap 20 can be made from plastic or leather. It is not essential that the strap be flexible although some flexibility promotes comfort for the wearer. A rigid strap, e.g., a rigid plastic strap, or a combined strap and cup made as an integral assembly from hard rigid plastic, offers a safety advantage as well as a cost advantage. With a rigid chin guard assembly, part of the impact of a ball with the chin cup is translated to the helmet, and thus, reduces the impact to the chin.

Alternatively, the helmet can be removed by first removing the chin guard, i.e., lifting the chin cup over the chin thus releasing the helmet from the head. In this mode the helmet may be placed on using the chin guard by first putting on the cap, then pulling the chin cup in place. It is helpful in this mode of operation if the strap 20 is elastic.

Figure 4:
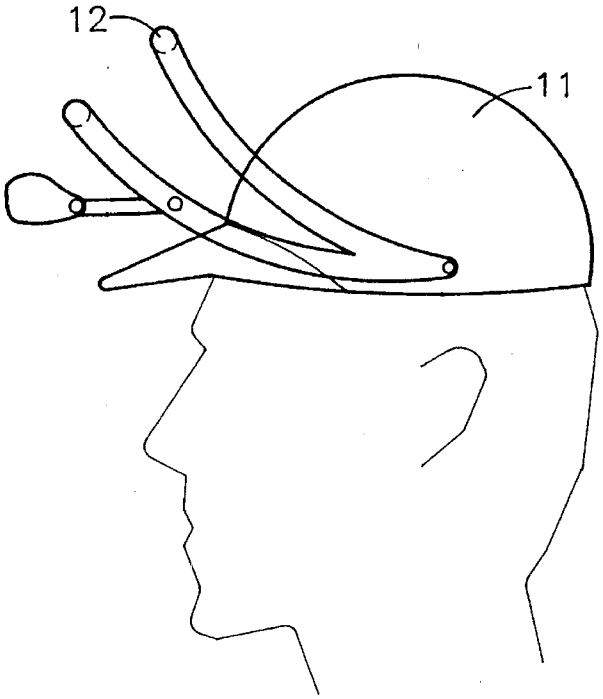
FIG. 4 is a view illustrating rotation of the faceguard to a "rest" position.

An important feature of this invention is illustrated in FIG. 4, and shows the faceguard 12 pivoted all the way over the cap to a rest position on the visor of the cap. As mentioned earlier the rest position is useful when the player is not engaged in the field. As is evident it is necessary that the faceguard be pivotally mounted in such a way that it is free to rotate at least 270°.

It will thus be understood that the invention affords flexibility to the player in putting on and removing the equipment in addition to substantial and multidimensional safety protection. Ease of use factors are important, especially with young players, to acceptance of safety products.

Figure 5:
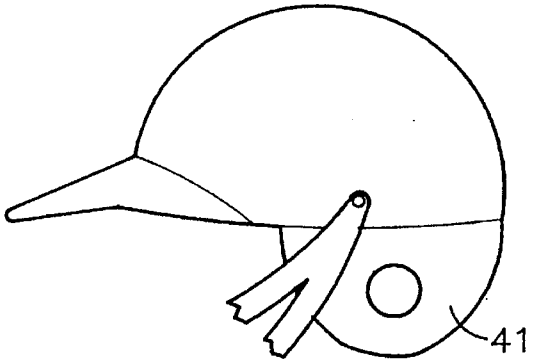
FIG. 5 is a view similar to that of FIG. 3 showing a protective helmet suitable for both batting and fielding.

While the protective helmet of the invention is designed primarily from the perspective of the safety of baseball fielders, and such designs are considered preferred embodiments of the invention, it can also be used for protection of baseball batters. An embodiment suitable for both is shown in FIG. 5. The helmet is of the same basic design as the helmet of FIG. 2 except that ear covering 41 has been added. The ear covering may be added to either side of the helmet to accommodate left- or right- handed batters respectively. Use of this protective gear allows the player to wear one piece of equipment through an entire game, and may justify equipment tailored to individual players.

Figure 6:
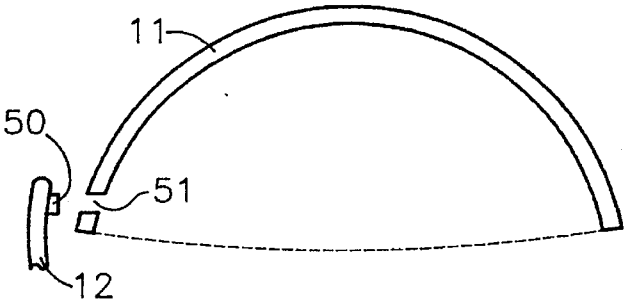
FIG. 6 is a schematic view of the rear of the helmet of FIGS. 1–3 showing an alternative fastener arrangement for removably attaching the faceguard to the cap.

As an alternative to the above, the helmet of the invention may be made with the faceguard removable. In that case the helmet nominally used for batting would be provided with means to accommodate the installation of a fielders mask. For example, the fastener 14 in FIG. 2 is made so that faceguard 12 is easily removed from cap 11 to accommodate easy assembly or disassembly of the helmet 10. If both the cap 11 and the faceguard 12 are plastic the faceguard can be molded with an integral pin as shown in FIG. 6. Here the cap 11 is shown in a vertical section taken through the point of attachment (14 in FIG. 2) of the faceguard and the cap, and for simplicity only a portion of the faceguard where it attaches to the cap is shown. The pin 50 is adapted to engage a hole 51 in the helmet. Plastic materials used in this kind of equipment, e.g., ABS, while rigid for protection, are also typically resilient, i.e., they flex, sufficiently that a snap fitting can be made. The pin 50 and hole 51 can be reversed if desired so that the pin does not protrude toward the wearer's head.

Figure 8:
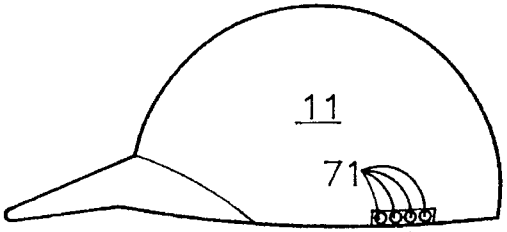
FIG. 8 is a side view of the cap portion of the helmet of FIG. 2, with the faceguard removed, showing a means for adjusting the position of the faceguard.
Figure 7:
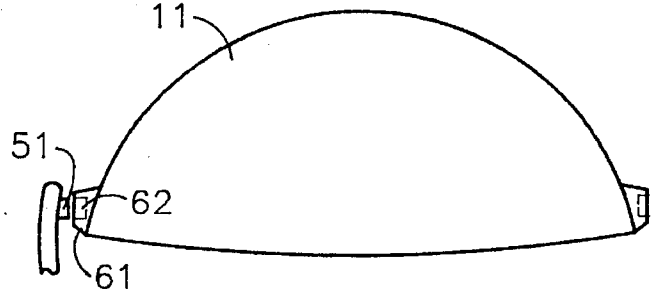
FIG. 7 is a schematic view similar to that of FIG. 5 showing a fastening means useful as an alternative to that shown in FIG. 5.

A similar approach to attaching the faceguard to the cap is shown in FIG. 7. Here a molded rib 61 is shown on the exterior of the cap 11. The thickness of the rib is sufficient to accommodate a blind hole 62 so that the pin 51, after insertion into the blind hole, cannot penetrate through the cap. An additional feature can be added with ease and low cost by providing multiple holes as shown in FIG. 8. The multiple holes 71 allow adjustment of the position of the faceguard on the cap to accommodate different head sizes and shapes. The holes 71 are shown round to allow the faceguard to pivot for reasons described earlier. For a fixed, non-pivoting attachment, a square hole or holes, and a square pin or pins can be substituted for the round pin and hole 50, 51, 61 and 71. The square holes are adapted to engage a square pin and fix the rotational position of faceguard 12 with respect to cap 11. Other designs for fasteners, both fixed and pivotal, and both detachable and permanent, will become evident to those skilled in the art.

Figure 9:
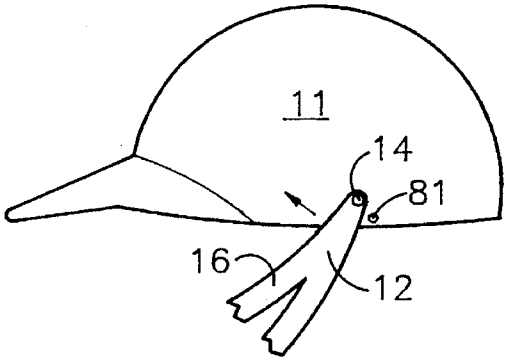
FIG. 9 is a schematic representation of a portion of the helmet of this invention showing an alternative arrangement for pivotally attaching the faceguard to the helmet.

As mentioned earlier it may be desirable to restrict the rotational angle of the faceguard with respect to the cap in the embodiment where the attachment between the two is otherwise pivotal, e.g., the embodiment illustrated in FIG. 3. That objective can be met in a variety of ways. One example is shown in FIG. 9, which is a diagram of just portions of the faceguard 12 and cap 11 showing the region where the attachment between them is made. The pivotal fastener is shown at 14. To allow rotational movement of the faceguard with respect to the cap in the direction of the arrow shown in the Figure, but restrict the rotation in the opposite direction, a stop is provided on the cap e.g., by molding a pin 81 as shown. The pin 81 prevents rotation of the faceguard and prevents a ball from entering the gap between the nose protective bar 16 and the cap 11.

Figure 10:
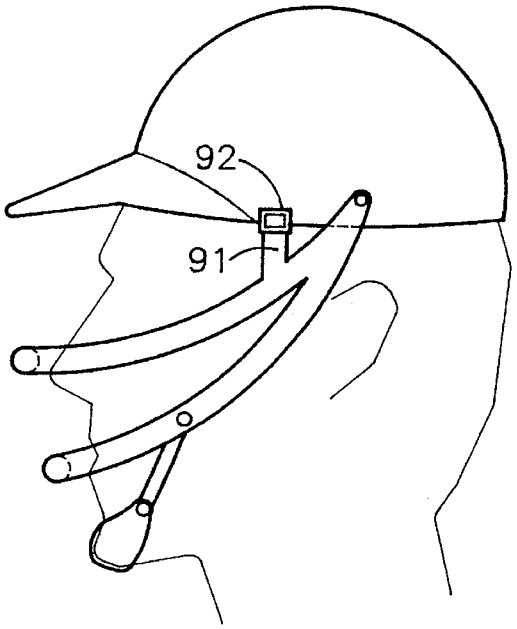
FIG. 10 is a side view similar to that of FIG. 2 showing a protective helmet with added eye protection.

Another solution is shown in FIG. 10 wherein retaining member 91 is provided in the temple region of the wearer to restrict the distance the faceguard is allowed to pivot downwardly. As mentioned earlier this is desirable to prevent accidental exposure of the eye region of the face to batted or thrown balls. The retaining member extends between the faceguard and the cap as shown. The retaining member 91 is conveniently made integral with the faceguard as shown. In the retaining member 91 snaps or clips to the cap using one of various possible clip mechanisms represented by 92.

Figure 11:
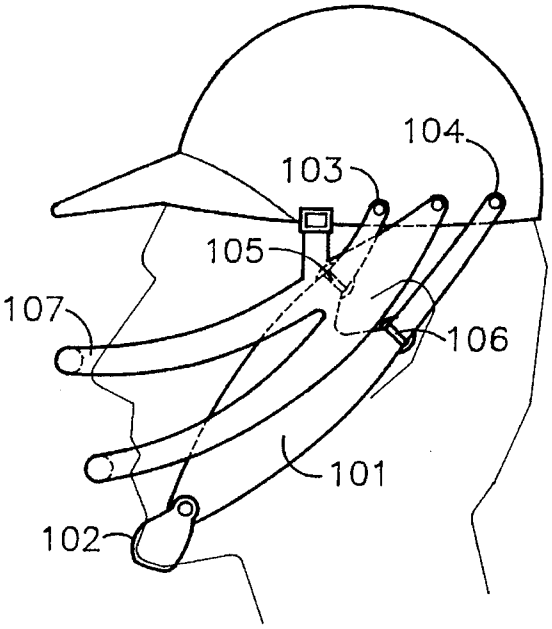
FIG. 11 is a similar view of a protective helmet having an alternative means for attaching the chin strap.
Figure 12:
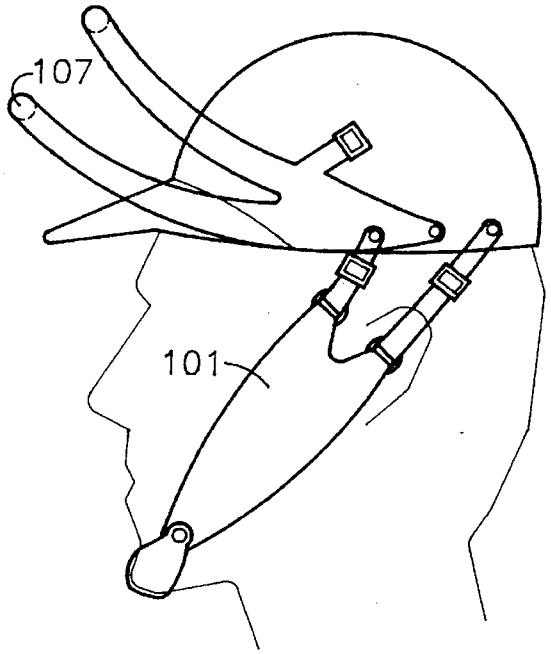
FIG. 12 illustrates the helmet arrangement of FIG. 11 with the faceguard in the rest position.

In the foregoing description the chin strap is shown attached to the faceguard. Alternatively, the chip strap may attach to the helmet. This embodiment is illustrated in FIGS. 11 and 12. Referring to FIG. 11 the face chip cup 102 is shown attached to the cap with chin strap 101. In this embodiment the chip strap is attached at two positions on the cap using fasteners 103 and 104. Alternatively, a single strap can be used. The straps are shown with adjustment clips 105 and 106 for adjusting the chip strap and chin cup to the wearer. A feature of the arrangement shown in FIG. 11 is that the faceguard 107 and the chip strap 101 operate independently allowing the faceguard to be in the rest position with the chin strap still employed, as shown in FIG. 12.

It will be noted that the spacing "s" (referring to FIG. 2) is greater in FIG. 11 than in FIGS. 2 and 10 although the spacing is still within the allowed 2¼ to 2½ inch maximum. The choice of a larger spacing as shown in FIG. 11 gives added protection to the chin region.

While this invention has been described in connection with baseball, other games, such as softball and cricket, may require the safety features of the invention and are not meant to be excluded from the scope of the invention.

Various additional modifications and deviations from the invention as described in this specification will occur to those skilled in the art. All variations that basically rely on the teachings through which this invention has advanced the safety of participants in sports activity are properly considered to be within the scope of the invention as described above and as claimed in the appended claims.

I claim:

1. A protective helmet for use by fielders while fielding or catching balls comprising a cap portion substantially in the shape of a baseball cap having a visor and a head covering for covering for the head above the ears, a protective faceguard attached to each side of the helmet at points on the rear half of the cap portion so that the faceguard is adapted to extend past the temporal regions of the head of the wearer and encircle the face of the wearer, said faceguard comprising a nose protective bar adapted to shield a portion of the nose and eyes of the wearer, and a mouth protective bar adapted to shield the mouth of the wearer, means for fixing the spacing between the nose protective bar and mouth protective bar, and a chin guard adapted to engage the chin of the wearer, and being attached to the faceguard on each side of the faceguard so that the spacing between the chin guard and mouth protective bar is fixed whereby when the protective helmet is worn the chin, mouth, nose, eyes and the temporal areas of the wearer are protected against impact by a ball during the fielding or catching thereof.

2. The protective helmet of claim 1 wherein the faceguard is rotatably mounted on the cap portion so as to be movable in a rotational direction toward the said visor of the cap portion from the active position in front of the face of the wearer to an inactive position abutting said visor.

3. The protective helmet of claim 2 further including means for restricting the rotation of the faceguard with respect to the visor of the cap portion in a rotational direction away from the visor of the cap portion.

4. The protective helmet of claim 1 wherein the faceguard is fixedly attached to the cap portion.

5. The protective helmet of claim 1 wherein the cap portion and the faceguard are constructed of plastic.

6. The protective helmet of claim 5 where in the chin guard is constructed of plastic.

7. The protective helmet of claim 1 wherein the chin guard is attached with a chin strap to the mouth protective bar of the faceguard at points adjacent the cheeks of the wearer.

8. The protective helmet of claim 7 further including means for adjusting the length of the chin strap.

9. The protective helmet of claim 1 wherein the faceguard is removable from the cap portion.

10. The protective helmet of claim 1 wherein the cap portion further includes at least one ear guard portion extending from the side of the cap portion and adapted to cover at least one ear of the wearer.

11. The protective helmet of claim 9 wherein the faceguard is made of a material that allows it to flex and said faceguard and said cap portion include attachment means for snap fitting the faceguard to the cap portion.

12. The protective helmet of claim 11 wherein the attachment means includes means for attaching the faceguard to the cap portion at more than one position.

13. The protective helmet of claim 1 wherein the faceguard is rotatably mounted on the cap portion so as to be movable in a rotational direction from an active position in front of the face of the wearer to a rest position with the faceguard resting on the visor of the cap.

14. The protective helmet of claim 13 wherein the faceguard is rotatably movable through at least 270 degrees.

* * * * *